US005794709A

United States Patent [19]

Clausen

[11] Patent Number: 5,794,709

[45] Date of Patent: Aug. 18, 1998

[54] COUNTERMINE BREACHING POWER BLADE

[76] Inventor: Glen C. Clausen, Rte. 2, Box 12, McPherson, Kans. 67460

[21] Appl. No.: 639,740

[22] Filed: Apr. 29, 1996

[51] Int. Cl.[6] ..... E02F 5/02; E02F 5/22

[52] U.S. Cl. ..... 172/33; 172/811; 172/766; 37/301; 37/463; 37/903

[58] Field of Search ..... 37/301, 388, 190, 37/463, 903; 172/33, 811, 766

[56] References Cited

U.S. PATENT DOCUMENTS

| | | | |
|---|---|---|---|
| 1,974,668 | 9/1934 | Souter | 37/463 X |
| 2,679,701 | 6/1954 | Busque | 37/301 |
| 2,771,693 | 11/1956 | Busque | 37/301 |
| 2,840,933 | 7/1958 | Brem | 37/301 X |
| 3,081,564 | 3/1963 | Prater | 37/301 |
| 3,111,777 | 11/1963 | Prater | 37/301 X |
| 3,163,945 | 1/1965 | Dooley | 37/301 X |
| 3,272,559 | 9/1966 | Haynes | 172/33 X |
| 3,744,568 | 7/1973 | Beyers et al. | 172/33 |
| 4,358,905 | 11/1982 | Maxwell . | |
| 4,512,090 | 4/1985 | Billings | 37/301 X |
| 4,727,940 | 3/1988 | Bar-Nefy et al. | 172/33 X |

OTHER PUBLICATIONS

Clausen Power Blade, Inc.; Clausen Power Blade; 1993; McPherson, Kansas.

*Primary Examiner*—Michael J. Carone
*Assistant Examiner*—Christopher J. Novosad
*Attorney, Agent, or Firm*—Shook, Hardy & Bacon L.L.P.

[57] ABSTRACT

A device is provided for clearing a swath within the earth. The device has a frame for mounting the device onto an industrial vehicle. A rotating track is disposed on the frame. At least one reinforcing panel is mounted adjacent an end of the track that protects the end of the track from binding and damage due to obstacles disposed on the swath being cleared. A bottom plate is disposed directly beneath the track, and a top protecting shield is disposed above the track. When the vehicle moves forward, the bottom plate and the track operate to move a layer of earth from in front of the vehicle to a side of the vehicle.

18 Claims, 2 Drawing Sheets

COUNTERMINE BREACHING POWER BLADE

BACKGROUND OF THE INVENTION

The present invention relates to a novel earth moving device. More particularly, the invention is directed to an earth moving device which can be attached to the front end of an endless track vehicle and which can be used for moving earth, and obstacles on and within the earth, to the side of the vehicle.

In today's military environment, it is often necessary to quickly establish a path suitable for travel by people or vehicles. In establishing such a path, it will often be necessary to remove both landmines and surface obstacles such as concrete or Jersey barriers. A number of different machines have been designed to address this objective. All of these machines have failed to fully satisfy the above objectives.

One particular device which has been developed is a mine-clearing rake. The mine clearing rake is mounted on the front of a tank or other endless track vehicle. The rake engages the ground in front of the tank and pushes the ground, including any mines within the ground, to the front of the tank, thus leaving a path behind the tank.

Another device for clearing such a path also involves attaching a device to the front of a tank. This second device is a V-shaped blade with the center of the V in the center of the vehicle. The V-shaped blade also has ground engaging teeth on its lower end. The device is thus used to engage the ground and to push the earth in front of the vehicle to either side of the vehicle.

A major disadvantage with each of these devices is that the earth can accumulate in front of the device and thus will not properly be pushed to the side of the vehicle. As material accumulates in front of the device, a larger and larger propelling force is required to sustain forward movement of the vehicle. Therefore, because the earth tends to accumulate in front of the vehicle, larger propelling vehicles are required. The use of larger propelling vehicles is both more expensive and less efficient. Further, while the above devices are used to clear a path where landmines are found within the earth, these two devices are not well suited for clearing a path when larger obstacles are disposed upon the earth, such as concrete barriers.

Yet another device that has been proposed for clearing such a path is the device disclosed in U.S. Pat. No. 4,358,905. This device is mounted on the front end of an endless track vehicle. The device has a lower blade which engages the earth. The earth then encounters a laterally disposed rotating track that moves the earth to the side of the track. This device does not have the disadvantage of earth accumulating in front of the vehicle because the track continuously moves the earth to the side of the vehicle. However, this device also has several disadvantages. First, the ends of the rotating track are exposed. When the ends of the track are exposed, the track can be more easily damaged. This is especially true when concrete barriers are encountered. Further, when the ends of the track are exposed the likelihood that foreign matter will become wedged between the track and the support frame increases, thus decreasing the reliability of the device. Second, the lower blade on the bottom of the device is not well suited for severing a layer of earth beneath the level containing any landmines. Third, when this device is used, the propelling vehicle tends to stray from a straight path. Thus, when this device is used, the operator of the vehicle must constantly monitor and correct the path of the vehicle to attempt to form a straight path.

Therefore, a device is needed which will clear a path within the earth. Further, a device is needed which will clear such a path when the earth contains landmines and when obstacles, such as concrete barriers, are disposed on top of the earth.

A device is also needed that will clear a path within the earth by continuously and positively moving the earth to the side of the vehicle, thus allowing the propelling vehicle to operate without the engaged earth accumulating in front of the vehicle.

Still further, a device is needed that will clear a path within the earth and that will encourage the propelling vehicle to travel in a straight path.

SUMMARY OF THE INVENTION

It is a primary object of the present invention to provide a device for mounting onto the front of an endless track vehicle which can be used to clear a swath within the earth by continuously and positively moving the earth to the side of the vehicle, where the device is protected from damage caused by the earth as well as objects disposed on and within the earth.

A further object of this invention is to provide a device which can clear a swath within the earth upon which is disposed a series of obstacles, such as concrete blocks.

It is yet another object of this invention to provide a device that engages the earth and which is equipped to guide the vehicle in a straight path.

It is a still further object of this invention to provide a device which can clear a swath within the earth, where the earth is equipped with a series of landmines.

According to the present invention, the foregoing and other objects are obtained by a device for clearing a swath within the earth that has a frame for mounting the device onto an industrial vehicle. A rotating track is disposed on the frame. At least one reinforcing panel is mounted adjacent an end of the track that protects the end of the track from binding and damage due to obstacles disposed on the swath being cleared. A bottom plate is disposed directly beneath the track, and a top protecting shield is disposed above the track. When the vehicle moves forward, the bottom plate and the track operate to move a layer of earth from in front of the vehicle to a side of the vehicle. A series of ground engaging teeth are provided that act, in part, to maintain a straight direction of travel for the vehicle.

Additional objects, advantages, and novel features of the invention will be set forth in part in the description which follows, and in part will become apparent to those skilled in the practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE PREFERRED EMBODIMENT

Figure 3:
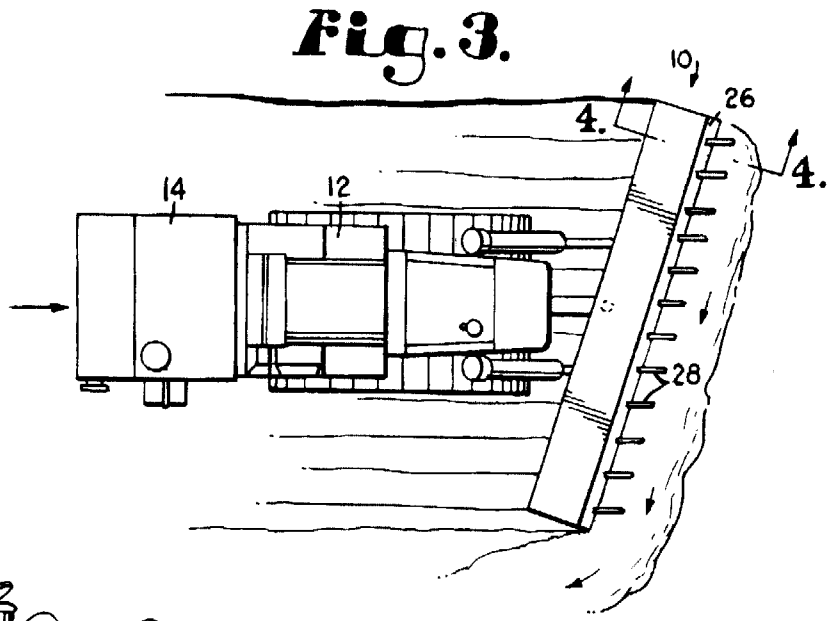
FIG. 3 is a top plan view of the device of FIG. 1 with the device shown engaging the ground and moving the ground to one side.

An attachment embodying the principles of this invention is broadly designated in the drawings by the reference numeral 10. Attachment 10 is shown mounted to the front end of an endless track vehicle 12. Vehicle 12 has a power source 14, which is shown as being mounted on the rear of vehicle 12. Mounting power source 14 on the rear of vehicle 12 allows the power source to counterbalance the weight of attachment 10.

Figure 1:
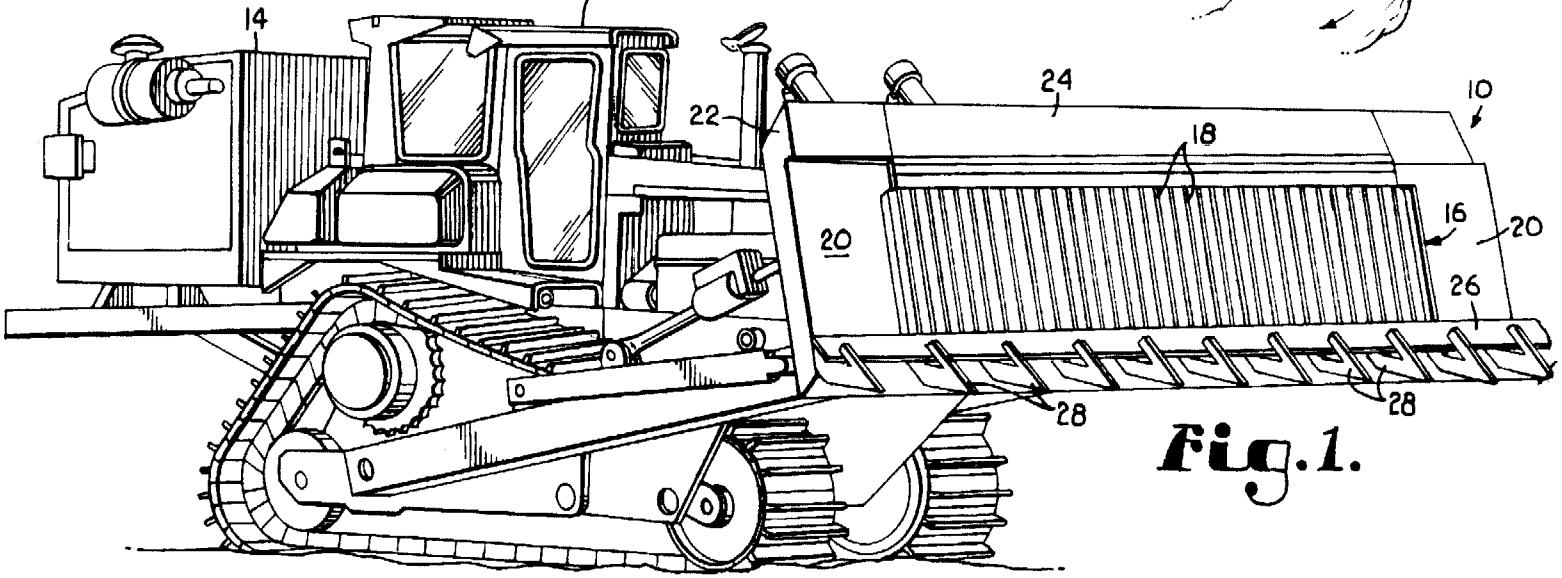
FIG. 1 is a front perspective view of an attachment according to the present invention shown mounted to an endless track vehicle.
Figure 8:
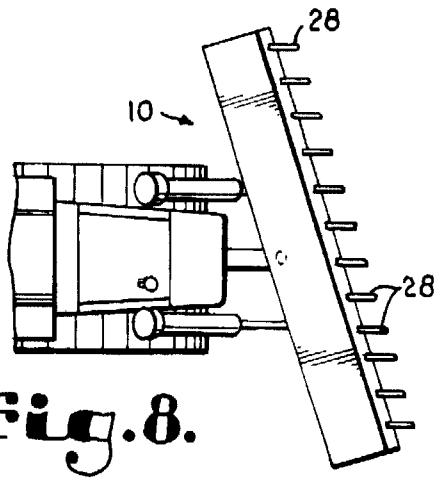
FIG. 8 is a top plan view of the attachment similar to the view shown in FIG. 3 with the attachment shown at an alternate angle.
Figure 5:
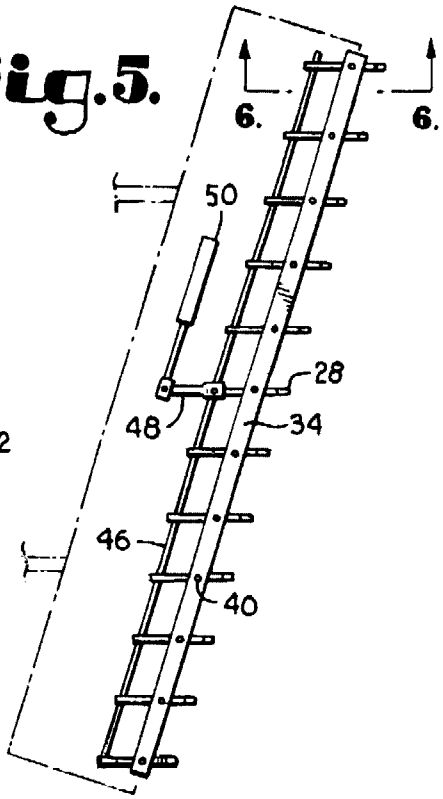
FIG. 5 is a top view taken line 5—5 of FIG. 4.

Attachment 10 can be raised and lowered by vehicle 12. Attachment 10 is shown in a raised position in FIG. 1 and in a lowered position in FIG. 2. Further, attachment 10 can be angled with respect to vehicle 12. As shown in FIG. 3, the left side of attachment 10, as viewed from the operator's position in vehicle 12, is shown further away from vehicle 12 than is the right side. The side of attachment 10 further away from vehicle 12 is referred to as the "long side," and the side of attachment 10 closest to vehicle 12 is referred to as the "short side." Conversely, as shown in FIG. 8, the left side of attachment 10 is shown as the short side and the right side is shown as the long side. As shown in FIG. 3, the ground will be moved to the short side of vehicle 12. Attachment 10 can thus be angled with respect to vehicle 12 so that the ground is always moved to the short side.

The main body of attachment 10 is constructed of a sturdy framework. Attachment 10 includes a laterally mounted conveyor track 16. A description of the framework of attachment 10 along with a description of the means used to rotate track 16 is shown in U.S. Pat. No. 4,358,905 to Maxwell, the disclosure of which is hereby incorporated herein by reference. Conveyor track 16 has vertically oriented ribs 18. Ribs 18 aid in gripping the earth and moving it to the side of the vehicle, as will be more fully described below.

Disposed immediately adjacent each end of track 16 are reinforcing panels 20. Each panel 20 is spaced a sufficient distance from the end of track 16 to allow track 16 to rotate freely. The space between track 16 and panel 20 is kept as small as possible, however, to prevent any large objects from becoming wedged between track 16 and panel 20. Panel 20 is preferably made from a rigid, high strength material, such as steel. Panel 20 can be affixed to attachment 10 with any suitable attaching means, such as bolts or welding.

On each end of attachment 10 is an end plate 22. End plate 22 is made of material similar to that of panel 20. End plate 22 is preferably bolted to the framework of attachment 10 so that it can be removed if maintenance is necessary. Other attaching means could be used and are within the scope of this disclosure. Panels 20 and plates 22 thus cooperate to protect the ends of track 16 from any damage that may be caused by material that is being moved by attachment 10.

Mounted directly above track 16 is a safety shield 24. Shield 24 extends along the entire length of attachment 10. Shield 24 protects the top of track 16 from any material that is being moved by attachment 10, as well as protecting the internal mechanics of attachment 10. End plate 22 extends to the top of shield 24, thus completely protecting the ends and the top of track 16. End plate 22 may also be manufactured in two pieces, so that a lower piece covers the side of track 16, with an upper piece enclosing the area to the side and above track 16. A two-piece end plate 22 may ease access to the end of track 16, such as may be necessary for maintenance purposes.

Disposed directly beneath track 16 and extending along the entire length of attachment 10 is a bottom plate 26. Bottom plate 26 can be welded directly to the framework of attachment 10. Bottom plate 26 is preferably mounted at an obtuse angle with respect to track 16. A preferred angle between track 16 and plate 26 is 117 degrees. Plate 26 operates to sever a layer of soil from the surface of the earth. The layer of soil is thereafter transported to the side of the vehicle by track 16. With the proper angle of plate 26, attachment 10 will sever the earth beneath any landmines within the earth. Severance of a layer of earth in this manner aids in the removal of any landmines without activating the landmines.

Mounted beneath plate 26 are a series of ground engaging teeth 28. Each of the teeth has a front portion that extends forwardly from plate 26 and a rear portion that extends rearwardly under plate 26. Teeth 28 have an irregular shape, which can best be seen in FIG. 6. Teeth 28 may have a tip 52 mounted thereon. Tip 52 protects the front portion of teeth 28 and penetrates into the soil in front of attachment 10, thereby aiding plate 26 in severing a layer of soil from the earth.

Teeth 28 also function as rudders within the engaged earth. Specifically, the rear portion of teeth 28 extending rearwardly under plate 26 acts as a rudder within the earth. As rudders, teeth 28 help to maintain vehicle 12 in a straight direction of travel. Without teeth 28, vehicle 12 tends to pull towards the side of track 16 that is furthest away from vehicle 12. In other words, vehicle 12 tends to pull towards the long side of track 16. Teeth 28 act as rudders to counteract this pulling force, and thus help to maintain a straight direction of travel. In order to guide vehicle 12 in a straight path, teeth 28 are oriented so that they are generally parallel to the direction of travel, even though track 16 is angled. Preferably, teeth 28 form an acute angle with respect to the long side of track 16 of approximately 81°. Further, teeth 28 are mounted to attachment 10 so that they may be rotated. If vehicle 12 is not traveling in a straight path, teeth 28 may be rotated accordingly to compensate and, therefore, ensure a straight direction of travel.

Figure 6:
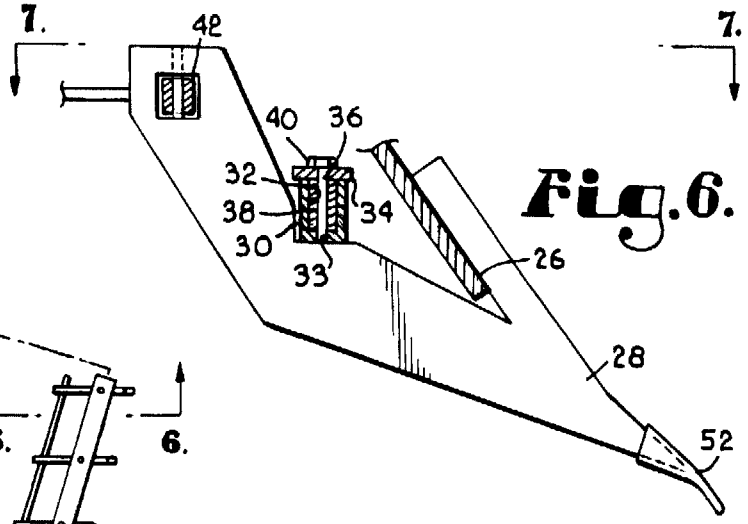
FIG. 6 is a side elevation view taken along line 6—6 of FIG. 5.

As can best be seen in FIG. 6, each tooth 28 has a pivot bushing 30 mounted thereon. Pivot bushing 30 defines a centrally disposed cylindrical bore 32. Bore 32 has a lower threaded end 33. Affixed to the frame of attachment 10 is a rigid mounting arm 34. Mounting arm 34 is secured to attachment 10 beneath bottom plate 26. Mounting arm 34 has a series of mounting apertures 36. Disposed beneath mounting arm 34 is a sleeve 38. Sleeve 38 is rigidly secured to mounting arm 34. Sleeve 38 has an outside diameter slightly less than the diameter of bore 32. Sleeve 38 has an inside diameter substantially equal to the diameter of mounting apertures 36. Sleeve 38 is disposed in bore 32 when teeth 28 are mounted to attachment 10. A connecting member 40 passes through mounting apertures 36 on arm 34, through sleeve 38, and is threaded into threaded end 33 of bushing 30. Connecting member 40 thus affixes each of the teeth 28 to arm 34 but allows teeth 28 to rotate about connecting member 40. It can therefore be seen that sleeve 38 acts as the bearing surface on which teeth 28 rotate.

Figure 7:
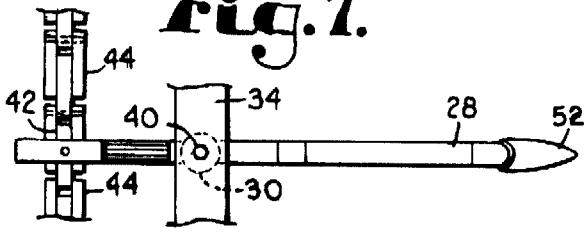
FIG. 7 is a top view taken along line 7—7 of FIG. 6.

Each tooth 28 also has a first pivot link 42 mounted thereon, as shown in FIG. 7. First pivot link 42 is rotatable about a vertical axis. First pivot links 42 are connected to second pivot links 44 with a series of connecting fasteners. Through the connecting fasteners, first pivot links 42 and second pivot links 44 are connected to form a continuous and flexible connecting chain 46. Chain 46 operates to couple teeth 28 together such that movement of one tooth effects a movement of all of the teeth. A linkage member 48 connects teeth 28 to a hydraulic cylinder 50. Hydraulic cylinder 50 supplies the power necessary to rotate teeth 28. When the ram of cylinder 50 is extended, tip 52 is rotated about connecting member 40 in a counterclockwise direction. Conversely, when the ram of cylinder 50 is retracted, tip 52 is rotated about connecting member 40 in a clockwise direction. Preferably, cylinder 50 can be actuated from a remote location, such as the cab of vehicle 12. Teeth 28 are therefore rotatable relative to track 16, and can thus be used to ensure that vehicle 12 maintains a straight direction of travel.

Figure 2:
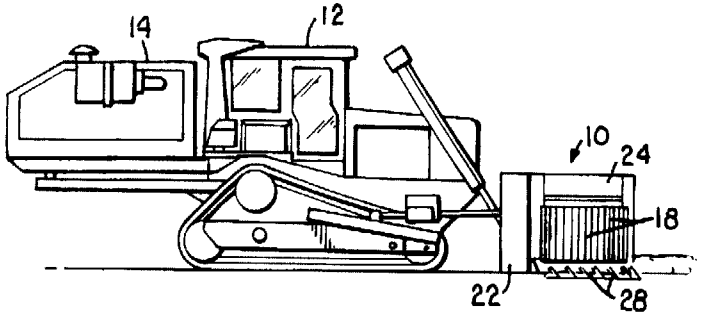
FIG. 2 is a side elevation view of the attachment of FIG. 1 with the attachment shown in a lowered, ground engaging position.
Figure 4:
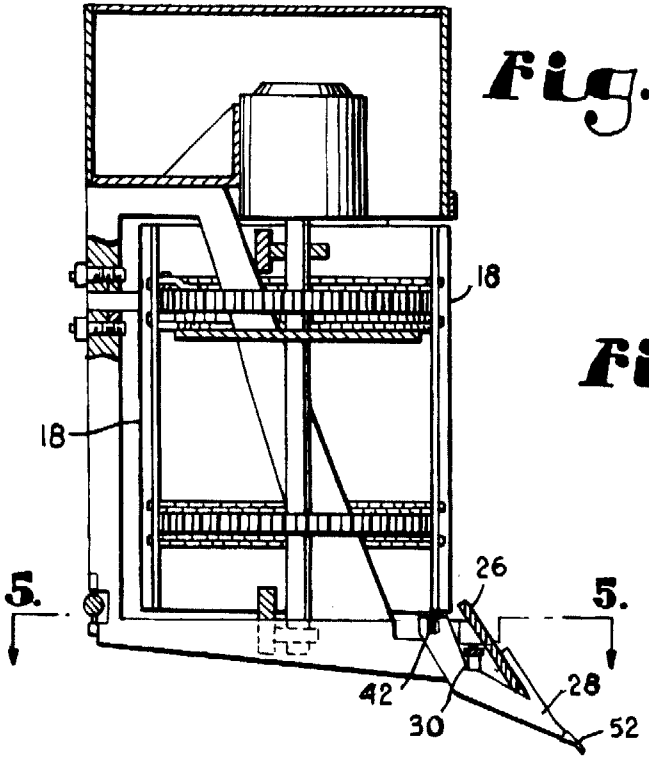
FIG. 4 is a cross sectional view of the attachment taken along line 4—4 of FIG. 3.

In operation, attachment 10 is lowered so that teeth 28 and plate 26 engage the ground, as best seen in FIG. 2. Teeth 28 and plate 26 operate to sever a layer of earth below the top surface of the earth. As vehicle 12 moves forward, the severed layer of earth contacts track 16. Ribs 18 on track 16 grip the layer of earth and move it to the side of vehicle 12. Because track 16 is constantly rotating, the earth will not accumulate in front of vehicle 12. Any obstacles within the earth, such as landmines, as well as any obstacles on top of the earth, such as concrete barriers, will be moved to the side of the vehicle along with the severed layer of earth. Panels 20, plates 22 and shield 24 operate to ensure that the earth and any obstacles do not cause damage to track 16. Teeth 28 act as rudders to encourage a straight direction of travel for vehicle 12. As can best be seen in FIG. 4, operation of attachment 10 clears a path with the earth. The path will be free from any landmines. Further, any obstacles disposed on top of the earth will have been moved to the side of the path. Therefore, the path created by attachment 10 is one free from obstacles or landmines and is therefore suitable for travel by vehicles or people. It can therefore be seen that attachment 10 is well suited for clearing a swath within the earth, even when the earth is laden with obstacles.

In an alternative embodiment, teeth 28 are rigidly fixed and are not rotatable. In this embodiment, teeth 28 are preferably fixed to attachment 10 so that they form an acute angle of approximately 81° with respect to the long end of track 16. This angle orients teeth 28 so that they are generally parallel to the direction of travel even though track 16 is angled. Thus, this angle enables teeth 28 to guide vehicle 12 in a straight path.

From the foregoing, it will be seen that this invention is one well suited to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A device for clearing a swath within the earth, said device comprising:

a frame for attaching the device to an industrial vehicle;

a rotating track disposed on said frame;

at least one reinforcing panel mounted adjacent an end of said track, said panel protecting said end of said track from binding and damage due to obstacles disposed on the swath being cleared;

a bottom plate disposed beneath said track;

a top protecting shield disposed above said track; and wherein as said vehicle moves forward, said track and said bottom plate operate to move a layer of earth from in front of said vehicle to a side of said vehicle.

2. The device of claim 1 wherein a reinforcing panel is mounted adjacent each end of said track.

3. The device of claim 1 wherein said bottom plate is mounted at an obtuse angle with respect to said track to sever the layer of earth from the earth surface, the track thereafter engaging the layer and moving it to one side of the vehicle by said track.

4. The device of claim 3 wherein said angle formed between said track and said plate is 117 degrees.

5. The device of claim 3 further comprising:

a plurality of rigid ground engaging teeth substantially disposed beneath said bottom plate;

each of said teeth having a front portion extending forwardly of said plate and a rear portion extending rearwardly from said front portion and beneath said plate; and wherein said front portion and said rear portion cooperate to maintain a straight direction of travel of said vehicle by operating as a rudder engaging the earth.

6. The device of claim 5 wherein said teeth are rigidly secured to the device.

7. The device of claim 6 wherein said teeth are secured to the device so that each of said teeth forms an angle with respect to said track of approximately 81°.

8. The device of claim 5 further comprising means for rotatably attaching said teeth to the device and wherein each of said teeth is rotatable about a generally vertical axis.

9. The device of claim 8 wherein said means for rotatable attaching said teeth to the device comprises:

a mounting arm having a plurality of teeth mounting apertures;

a cylindrical pivot bushing mounted to each of said teeth, said bushing defining a central bore having a lower threaded section;

a sleeve concentrically disposed in each said central bore, each said sleeve being rigidly secured to said arm, said sleeve defining a central, cylindrical passage;

a connecting member having a lower threaded end;

wherein said connecting member passes through one of said mounting apertures and through said central passage, said threaded end of said connecting member being threaded into said threaded section so that each of said teeth is free to rotate about said axis but is restricted from moving longitudinally along said track.

10. The device of claim 9 further comprising a means to rotate each of said teeth about said axis from a remote location.

11. The device of claim 11 wherein said means for rotating said teeth comprises:

a hydraulic cylinder;

a first pivot link associated with each of said teeth;

a connecting assembly coupling each of said plurality of teeth so that rotation of one of said teeth effectively rotates all of said teeth, said connecting assembly composed of said teeth, said first pivot links and a plurality of second pivot links, wherein said second pivot links are disposed between and connected to said first pivot links to form a continuous and flexible connecting chain;

a linkage member connecting said hydraulic cylinder to said connecting assembly; and whereby actuation of said cylinder rotates each of said teeth about said axis.

12. A device for clearing a swath within the earth, said device comprising;

a frame for mounting the device onto an industrial vehicle, said vehicle having a given direction of travel;

a rotating track disposed on said frame;

a bottom plate disposed beneath said track;

a plurality of ground engaging teeth disposed beneath said bottom plate;

wherein each of said teeth has a front portion extending forwardly of said plate and a rear portion extending rearwardly from said front portion and beneath said plate; and a means for rotating said plurality of teeth relative to the direction of travel of the vehicle.

13. The device of claim 12 wherein each of said teeth is rotatable about a generally vertical axis.

14. The device of claim 13 wherein said means for rotating said teeth comprises:

a hydraulic cylinder;

a first pivot link associated with each of said teeth;

a connecting assembly coupling each of said plurality of teeth so that rotation of one of said teeth effectively rotates all of said teeth, said connecting assembly composed of said teeth, said first pivot links and a plurality of second pivot links, wherein said second pivot links are disposed between and connected to said first pivot links to form a continuous and flexible connecting chain;

a linkage member connecting said hydraulic cylinder to said connecting assembly; and whereby actuation of said cylinder rotates each of said teeth about said axis.

15. A device for clearing a swath within the earth, said device comprising:

a frame for attaching the device to an industrial vehicle;

a rotating track disposed on said frame;

at least one reinforcing panel mounted adjacent an end of said track, said panel protecting said end of said track from binding and damage due to obstacles disposed on the swath being cleared;

a bottom plate disposed beneath said track;

wherein as said vehicle moves forward, said track and said bottom plate operate to move a layer of earth from in front of said vehicle to a side of said vehicle.

16. The device of claim 15, further comprising a top protecting shield disposed above said track.

17. The device of claim 16, wherein a reinforcing panel is mounted adjacent each end of said track.

18. The device of claim 17, further comprising:

a plurality of rigid ground engaging teeth substantially disposed beneath said bottom plate;

each of said teeth having a front portion extending forwardly of said plate and a rear portion extending rearwardly from said front portion and beneath said plate; and wherein said front portion and said rear portion cooperate to maintain a straight direction of travel of said vehicle by operating as a rudder engaging the earth.

* * * * *